United States Patent [19]

Windish et al.

[11] Patent Number: 4,560,034

[45] Date of Patent: Dec. 24, 1985

[54] ANNULAR MULTI-PISTON BRAKE APPARATUS

[75] Inventors: Willis E. Windish, Pekin; Marvin L. Schneider, Peoria, both of Ill.

[73] Assignee: Caterpillar Tractor Co., Peoria, Ill.

[21] Appl. No.: 747,685

[22] Filed: Jun. 24, 1985

Related U.S. Application Data

[63] Continuation of Ser. No. 577,644, filed as PCT US82/00293, Mar. 8, 1982, published as WO83/03133, Sep. 15, 1983, § 102(e) date, Mar. 8, 1982, abandoned.

[51] Int. Cl.[4] ..... F16D 55/22; F16D 65/24

[52] U.S. Cl. ..... 188/72.3; 188/106 F; 188/170; 192/83

[58] Field of Search ..... 188/71.5, 72.1, 72.3, 188/72.4, 72.5, 106 F, 106 P, 170, 367, 370, 264 E, 71.3, 360, 369; 192/83, 86; 303/6 M, 71

[56] References Cited

U.S. PATENT DOCUMENTS

| | | | |
|---|---|---|---|
| Re. 26,106 | 11/1966 | Dotto | 188/72.4 X |
| 3,260,331 | 7/1966 | Borman, Jr. | 188/72.4 |
| 3,547,233 | 12/1970 | Girvan | 188/72.3 X |
| 3,650,364 | 3/1972 | Laing | 188/72.4 |
| 3,659,685 | 5/1972 | Stipanovic | 188/72.5 |
| 3,946,837 | 3/1976 | Houser | 188/170 X |
| 3,974,896 | 8/1976 | Rach | 188/170 |
| 4,023,654 | 5/1977 | Winzeler | 188/170 |
| 4,024,936 | 5/1977 | Crabb | 188/170 X |
| 4,040,339 | 8/1977 | Ivey | 188/72.4 X |
| 4,184,573 | 1/1980 | Bricker et al. | 188/170 |
| 4,207,968 | 6/1980 | Chamberlain | 188/72.3 X |
| 4,207,969 | 6/1980 | Howell | 188/71.6 |
| 4,245,224 | 1/1981 | Beck | 188/170 |
| 4,263,991 | 4/1981 | Morgan et al. | 188/72.3 X |
| 4,279,330 | 7/1981 | Pottorff et al. | 188/170 X |
| 4,358,000 | 11/1982 | Cumming | 188/71.5 |
| 4,415,067 | 11/1983 | Cory | 188/71.5 |

FOREIGN PATENT DOCUMENTS

| | | | |
|---|---|---|---|
| 0258655 | 12/1967 | Austria | 188/72.3 |
| 2359043 | 6/1974 | Fed. Rep. of Germany | 188/170 |
| 0092641 | 12/1968 | France | 188/170 |

*Primary Examiner*—Bruce H. Stoner, Jr.
*Assistant Examiner*—Robert J. Oberleitner
*Attorney, Agent, or Firm*—Charles E. Lanchantin, Jr.

[57] ABSTRACT

An annular multi-piston brake apparatus (8) for selective holding engagement against a rotatable element (34). The annular multi-piston brake apparatus (8) advantageously includes first and second brake pistons (40,46) radially overlapping to allow the pistons to individually contact the rotatable element and stop rotation. Compact packaging of the brake apparatus is featured.

3 Claims, 1 Drawing Figure

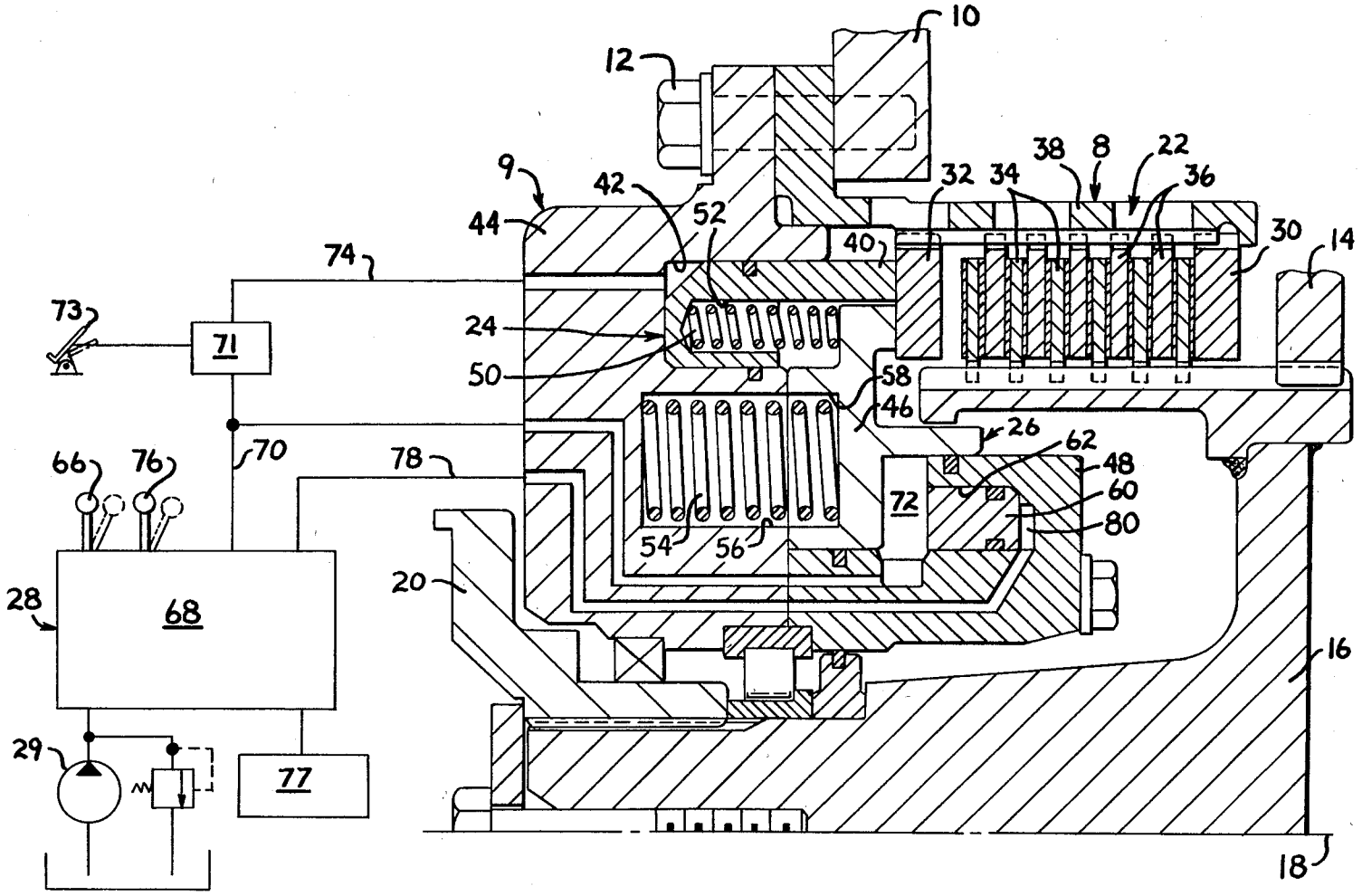
10
12
14
16
18
20
22
24
26
28
29
30
32
34
36
38
40
42
44
46
48
50
52
54
56
58
60
62
66
68
70
71
72
73
74
76
77
78
80
8
9

ANNULAR MULTI-PISTON BRAKE APPARATUS

This is a continuation of Ser. No. 577,644 filed Mar. 8, 1982, now abandoned.

DESCRIPTION

1. Technical Field

This invention relates generally to an annular multi-piston brake apparatus for disc-type brakes and more particularly to such a brake apparatus affording both service and parking brake capability in a relatively compact unit.

2. Background Art

Disc-type braking systems have for a number of years utilized dual piston apparatus having a fluid pressure applied service brake piston and a fluid pressure retracted/spring applied parking brake piston. The pistons were either located one on each side of a friction disc-pack or the parking brake piston reacted through the service brake piston in a series arrangement to apply pressure to the friction disc-pack. The apparatus having one piston on each side of the friction disc-pack requires a greater amount of space and also requires the entire friction disc-pack to move axially. In the series arrangement where the parking brake piston abutts and moves the service brake piston to apply the parking brakes, the parking brakes could not be applied if the service brake piston is damaged or cannot be moved and becomes inoperable.

The present invention is directed to overcoming one or more of the problems as set forth above.

DISCLOSURE OF INVENTION

In one aspect of the present invention an annular multi-piston brake apparatus having a friction pack with a pack engaging plate is provided for selective holding engagement against a rotatable element. A first and second piston means overlap to allow the piston to individually move the pack engaging plate into engagement with the rotatable element. A spring is positioned between the pistons.

BRIEF DESCRIPTION OF THE DRAWING

The drawing is a diagrammatic, fragmentary vertical cross section of an annular multi-piston brake apparatus embodying the principles of the present invention.

BEST MODE FOR CARRYING OUT THE INVENTION

With reference to the drawing, an annular multi-piston brake apparatus 8 having a three piece housing 9 and embodying the principles of the present invention is mounted and secured in a support structure 10 by a plurality of fastening means such as bolts 12. A gear 14 is used to transfer rotation from a power source (not shown) through an annular spindle 16 having a central axis 18 to drive an output flange 20.

The brake apparatus 8 has a friction pack means 22, a first brake actuating means 24, a second brake actuating means 26, and fluid pressure source means 28.

The friction pack means 22 includes a reaction plate 30, a pack engaging plate 32, and a plurality of annular brake discs 34 interleaved with a plurality of brake plates 36. The brake discs 34 are splined to the spindle 16 for rotation therewith. The reaction plate 30, pack engaging plate 32, and brake plates 36 are splined to a first piece 38 of the housing 9 to prevent rotation.

An annular service brake piston 40,which is pressure applied and spring released, is mounted within a groove or chamber 42 of a second piece 44 of the housing 9 and is reciprocally movable for directly contacting the pack engaging plate 32.

An annular parking brake piston 46, is normally pressure disengaged and spring applied, is mounted about a third piece 48 of the housing 9 and is reciprocally movable for directly contacting the pack engaging plate 32 at a point radially inward of the service piston 40.

One of a plurality of circumferentially spaced springs 50 is shown positioned between a bore 52 in the service brake piston 40 and the parking brake piston 46 to disengage the service brake piston or apply the parking brake piston.

One of a second plurality of circumferentially spaced springs 54 is shown positioned between a bore 56 in the second piece 44 of the housing 9 and a bore 58 in the parking brake piston 46 to move the parking brake piston 46 into an engaged position.

A third annular piston 60 is mounted within a groove 62 in the third piece 48 of the housing 9 and is reciprocally movable for contacting and moving the parking brake piston 46 into a disengaged position against the forces of springs 54. The piston 60 is used when the vehicle needs to be towed.

The fluid pressure source means 28 includes a pump 29 and a first manually operable control lever 66 and associated control system 68 of the spool valve type. In a first position of the control lever such a control system is adapted to communicate a source of fluid under pressure to a conduit and associated passage 70 to a brake valve 71 and an annular chamber 72, located between the parking brake piston 46 and the third piston 60, to hold the parking brake piston in a disengaged condition. A foot pedal 73 is movable from a first to a second position to communicate fluid under pressure from conduit 70 to the groove 42 via a conduit and associated passage 74 to move the service brake piston into an engaged condition. In a second position of the control lever the source of pressurized fluid can be blocked by the control system from both of these conduits and the conduits depressurized by communicating them back to a drain passage within the control system, not shown. When chamber 72 is depressurized the combined force of springs 50 and 54 automatically move the parking brake piston 46 into an engaged condition. A second manually operable control lever 76 using the same control system is adapted to communicate an auxiliary source 77 of fluid under pressure to a conduit and associated passage 78 to an annular chamber 80 for urging the third annular piston 60 leftwardly for moving the parking brake piston into a disengaged condition.

INDUSTRIAL APPLICABILITY

While the operation of the present invention is believed clearly apparent from the foregoing description, further amplification will be made in the following summary of operation. During vehicle movement the first control lever 66 is in the first full line position and the control system is adapted to communicate a source of fluid under pressure into conduit and associated passage 70 and parking brake chamber 72. Such fluid pressure in chamber 72 serves to fully disengage the parking brake piston 46 by overcoming the force of springs 54, and with the pedal 73 maintained in its full line first position, fluid is blocked by valve 71 from chamber 42. Thus, the axially leftward movement of the parking brake piston also serves to disengage the service brake piston 40 through the additionally axially compressed springs 50. Thus, the two pistons are placed in a disengaged condition.

Service braking is achieved by movement of the pedal 73 to its second broken line position and positioning the brake valve 71 to selectively deliver fluid from the conduit 70 to the conduit 74 and service brake actuation chamber 42 at a pressure that is proportionate to operator demand. The pressurization of chamber 42 forces piston 40 rightwardly, overcoming the spring 50, directly against the engaging plate 32 and stack of interleaved brake discs 34 and brake plates 36 to compress them against the reaction plate 30. In this way the discs are frictionally clamped to the housing 9, thereby holding the spindle 16 and flange 20 against rotation.

In a parking situation, the fluid pressure to the parking brake chamber 72 is drained through the control system 68. When the pressure drops below a predetermined value, the springs 54 and 50 are effective to bias the parking brake piston 46 directly abuttingly against the plate 32 to compress the brake discs 34 and brake plates 36 against the plate 30 to hold the spindle 16 stationary.

To move or tow the vehicle during a system failure, fluid pressure is introduced into conduit 78 from an auxiliary source 77 to pressurize piston chamber 80. The fluid pressure moves piston 60 leftwardly abuttingly against the parking brake piston 46. Continued movement overcomes the biasing force of springs 54 and 50 thus releasing the brake plates and discs and allowing spindle 16 to rotate.

While the invention has been described and shown with particle reference to a single embodiment, it will be apparent that variation might be possible that would fall within the scope of the present invention, which is not intended to be limited except as defined in the following claims.

We claim:

1. An annular multi-piston brake apparatus having a housing with friction pack means mounted therein, the friction pack means including an annular pack engaging plate for selective holding engagement against a rotatable element, comprising:

a first brake piston reciprocally movable for directly contacting and axially urging said pack engaging plate in a preselected direction;

a second brake piston positioned within said first brake piston and being reciprocally movable for directly contacting and axially urging said pack engaging plate in the preselected direction;

a first spring positioned between the pistons and urging the first brake piston in a direction opposite the preselected direction and urging the second brake piston in the preselected direction;

a second spring reacting against the housing and urging the second brake piston in the preselected direction; and fluid means for selectively urging the first brake piston in the preselected direction and for selectively urging the second brake piston in a direction opposite the preselected direction.

2. The annular multi-piston brake apparatus of claim 1 including a third piston reciprocally movable for contacting and axially urging the second brake piston in a direction opposite the preselected direction to overcome the force of the first and second spring to disengage the friction pack means.

3. An annular multi-piston brake apparatus having a housing with friction pack means mounted therein, the friction pack means including an annular pack engaging plate for selective holding engagement against a rotatable element, comprising:

a service brake piston reciprocally movable for directly contacting and axially urging said pack engaging plate in a preselected direction;

a parking brake piston reciprocally movable for directly contacting and axially urging said pack engaging plate in the preselected direction; a towing piston reciprocally movable for contacting and axially urging said parking brake piston in a direction opposite the preselected direction to disengage the friction pack means;

a first spring positioned between the service brake piston and the parking brake piston urging the service brake piston in a direction opposite the preselected direction and urging the parking brake piston in the preselected direction;

a second spring reacting against the housing and urging the parking brake piston in the preselected direction; and fluid means for selectively urging the service brake piston in the preselected direction, for selectively urging the parking brake piston in a direction opposite the preselected direction, and for selectively urging the towing piston in a direction opposite the preselected direction.

* * * * *